US006095791A

United States Patent [19]

Senior

[11] Patent Number: 6,095,791

[45] Date of Patent: Aug. 1, 2000

[54] FUEL INJECTOR ARRANGEMENT; METHOD OF OPERATING A FUEL INJECTOR ARRANGEMENT

[75] Inventor: Peter Senior, Countesthorpe, United Kingdom

[73] Assignee: European Gas Turbines Limited, United Kingdom

[21] Appl. No.: 08/755,978

[22] Filed: Nov. 25, 1996

[30] Foreign Application Priority Data

Dec. 6, 1995 [GB] United Kingdom ..... 9 524 959

[51] Int. Cl.[7] ..... F24C 5/00; F24M 3/02

[52] U.S. Cl. ..... 431/8; 431/12; 431/182; 431/354

[58] Field of Search ..... 431/8, 9, 12, 181, 431/182, 183, 354, 350

[56] References Cited

U.S. PATENT DOCUMENTS

| | | | |
|---|---|---|---|
| 1,918,326 | 7/1933 | Doble | 431/354 |
| 2,143,958 | 1/1939 | Pontius, Jr. . | |
| 4,261,511 | 4/1981 | Erb et al. . | |
| 4,383,820 | 5/1983 | Camacho | 431/8 |
| 4,897,089 | 1/1990 | Quang et al. . | |
| 4,967,561 | 11/1990 | Bruhwiler et al. . | |
| 5,487,659 | 1/1996 | Eroglu et al. . | |

FOREIGN PATENT DOCUMENTS

| | | |
|---|---|---|
| 0 297 955 A1 | 1/1989 | European Pat. Off. . |
| 0 638 769 A2 | 2/1995 | European Pat. Off. . |
| 1518756 | 3/1968 | France . |
| 1158600 | 7/1969 | United Kingdom . |
| 1 489 496 | 10/1977 | United Kingdom . |
| 1 594 598 | 7/1981 | United Kingdom . |
| 2 227 433 | 8/1990 | United Kingdom . |
| 85/00051 | 1/1985 | WIPO . |

*Primary Examiner*—James C. Yeung
*Attorney, Agent, or Firm*—Kirschstein, et al.

[57] ABSTRACT

A fuel injector arrangement for fluid fuel combustion apparatus comprises a conduit 31 for the flow of an airstream, a conduit 56 for the flow of fluid fuel to a housing 15 incorporating a fuel plenum chamber 25, the fuel plenum chamber 25 having at least one inlet orifice 22 and at least one outlet orifice 34 in substantially direct alignment, the inlet orifice(s) 22 being connected to the conduit 31 whereby, in use, air in the airstream flows into the plenum chamber to thereby force fuel out of the plenum chamber via the outlet orifice(s). The airstream may constitute a secondary airstream, there being, in use, a primary airstream which flows around and beyond the housing in a conduit 10 to receive the fuel forced out of the fuel plenum chamber.

17 Claims, 2 Drawing Sheets

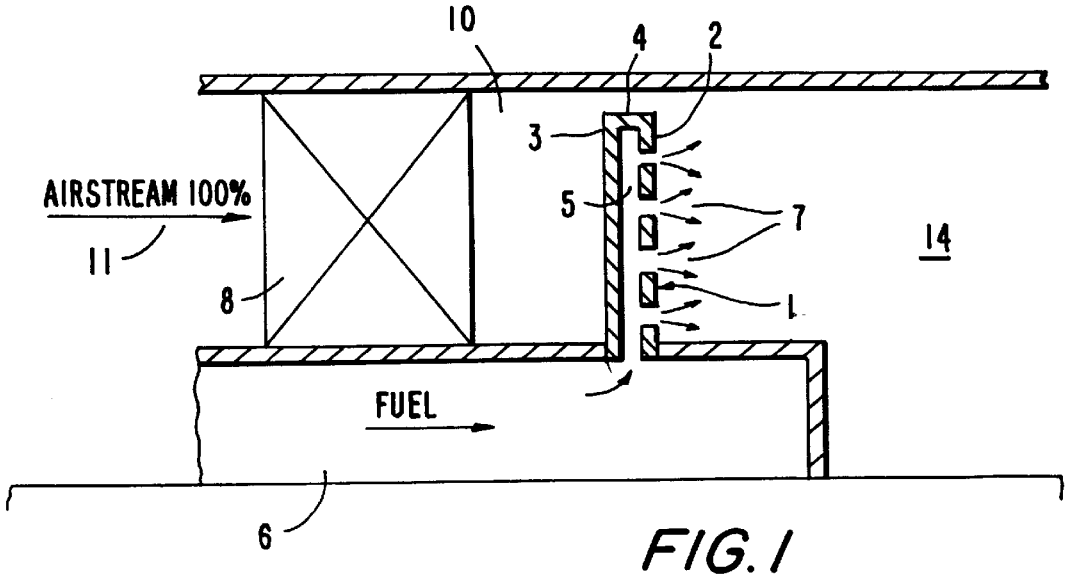
FIG. 1
PRIOR ART
FIG. 2
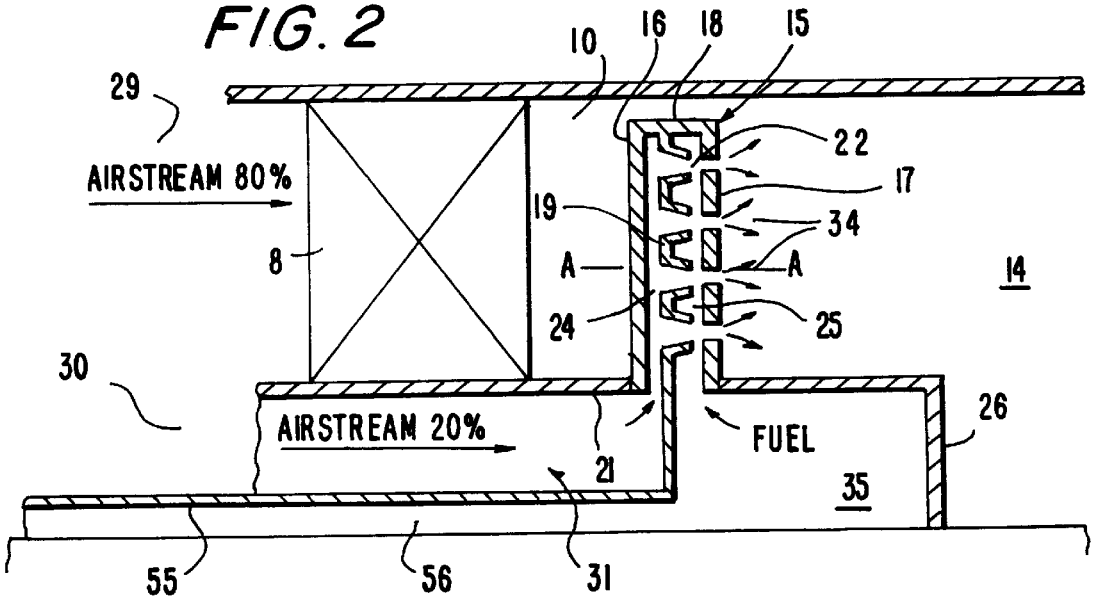
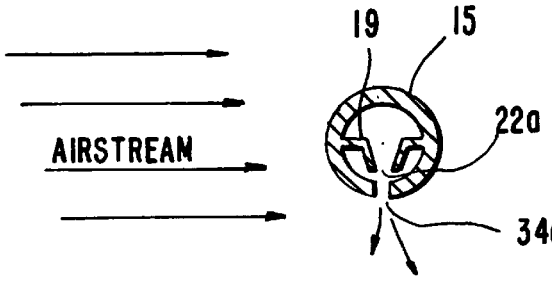
FIG. 2a

FUEL INJECTOR ARRANGEMENT; METHOD OF OPERATING A FUEL INJECTOR ARRANGEMENT

BACKGROUND OF THE INVENTION

This invention relates to a fuel injector arrangement and to a method of operating a fuel injector arrangement. The term injector arrangement is intended to cover mixing devices wherein fluid fuel and air are mixed to form a mixture to be burnt in combustion apparatus, e.g. turbines, engines, burners etc, and the term thereby covers inter alia carburetor and burner mixer arrangements. The invention is particularly suited to gas-fuelled lean-burn combustor arrangements.

FIG. 1 illustrates a conventional fuel injector arrangement comprising a housing which defines a chamber positioned in an annular airstream conduit 10. The housing 1 is defined by side walls 2, 3 and an end wall 4 and acts as a fluid fuel plenum 5 to which fluid fuel is supplied via a circular-section conduit 6 which is surrounded by the annular conduit 10. It should be understood that the housing 1 may inter alia take the form of a fuel post extending radially outwardly from the fuel conduit 6 with suitable interconnection therebetween for fuel to flow from conduit 6 to plenum 5 and there will generally be a plurality of such posts arranged around the conduit 6; in alternative realizations the housing 1 will be of annular or part-annular form extending around the whole or part of the circumference of the fuel conduit 6. In any event the housing 1 is formed with a plurality of radially and/or circumferentially spaced holes 7 or arrays of holes 7 through which jets of fuel pass into an airstream 11 which flows through the conduit 10 surrounding plenum 5 and which passes around and past the housing 1 to thereby entrain the fuel into the airstream 11. Conduit 10 conventionally contains blades 8 to swirl the airstream. The fuel and air mix together as the air moves downstream from the housing 1 to form a combustible mixture which is burnt in a combustion chamber 14.

This conventional arrangement suffers from a number of disadvantages. To ensure uniform distribution of the fuel and air there must be a large number of the holes 7 and thus each hole will be of small area. This means that the manufacturing techniques involve precise tolerances and also mean that, in use, the holes are prone to blockage through the build-up of deposits. With holes blocked in this way poor entrainment of fuel and inefficient combustion of the fuel will result. Furthermore, small holes limit the penetration of fuel into the airstream and thus restrict the efficiency of the fuel/air mixing process.

The present invention aims to provide a fuel injector arrangement which overcomes these disadvantages.

SUMMARY OF THE INVENTION

According to a first aspect of the invention there is provided a fuel injector arrangement for fluid fuel combustion apparatus, comprising air supply means connected to first and second conduits for the provision of a primary and a secondary airstream in respective said conduits, and a third conduit for the flow of fluid fuel to a housing, said housing incorporating a fuel plenum chamber having at least one pair of orifices in substantially direct alignment, said orifices being constituted by an inlet orifice and an outlet orifice, the inlet orifice(s) being connected to the second conduit whereby, in use, air in the secondary airstream flows into the plenum chamber to thereby force fuel out of the plenum chamber via the outlet orifice(s) into the first conduit where said fuel is entrained in said primary airstream.

In a preferred embodiment a higher proportion of the air supplied by the air supply means is directed into the primary airstream than is directed into the secondary airstream, e.g., approximately 80% of the air supplied by the air supply means is directed into the primary airstream and approximately 20% of the air supplied by the air supply means is supplied to the secondary airstream.

The first conduit may be of annular form and surround the second conduit, and the second conduit may be separated from the third conduit by a barrier.

Further, the barrier may be an extension of a barrier in the housing, the housing barrier being formed with the inlet orifice(s).

The housing may be defined at least partly between a side wall and an end wall of the second conduit or may take the form of a post extending radially from a wall, or may take the form of a post extending radially into the path of the primary airstream from a wall dividing the first conduit from the second conduit, or may be of annular or part-annular form extending radially from a wall dividing the first conduit from the second conduit.

The or each outlet orifice may be arranged such that fuel is forced into the primary airstream in line with the direction of flow of the primary airstream, or alternatively may be arranged such that fuel is forced into the primary airstream at an angle to the direction of flow of the primary airstream.

In a preferred arrangement the fuel plenum chamber constitutes a first fuel chamber for the receipt of one fuel, and there is provided a second fuel plenum chamber for the receipt of a second fuel, in use, and the second fuel plenum chamber may be connected by at least one orifice to the second conduit whereby the second fuel may flow into the first fuel plenum chamber.

The one fuel and the second fuel may be of different calorific values and control means may be provided to control the flow of the two fuels in response to operating conditions of the combustion apparatus.

According to a further aspect the invention provides a fuel injector arrangement for a fluid fuel combustion apparatus comprising a first conduit for the flow of an airstream, a second conduit for the flow of a first fuel to a first fuel plenum chamber, the first fuel plenum chamber having at least one pair of orifices in substantially direct alignment, said orifices being constituted by an inlet orifice and an outlet orifice, the inlet orifice(s) being connected to the first conduit, the arrangement also comprising a third conduit for the flow of a second fuel to a second fuel plenum chamber, the second fuel plenum chamber having at least one outlet orifice in substantially direct alignment with a said outlet orifice of the first fuel plenum chamber.

The second fuel may flow from the second fuel plenum chamber and into the first fuel plenum chamber via the first conduit.

It is preferred that the first fuel and the second fuel have different calorific ratings, and control means may be provided to control the flows of the two fuels in response to operating conditions of the combustion apparatus.

In any of the arrangements delineated above the or each outlet orifice of the fuel plenum chamber or of the first fuel plenum chamber may be of larger cross-sectional area than the cross-sectional area of the or each inlet orifice thereof.

In a further aspect the invention provides a method of operating a fluid fuel injector arrangement, wherein air in an airstream is caused to flow into a fuel plenum chamber containing a fluid fuel via at least one inlet orifice of said fuel plenum chamber, and said fuel is forced by said flow of air from said first plenum chamber via at least one outlet orifice thereof into a further airstream.

It is preferred that such method comprises the further steps of cutting off the flow of said fluid fuel into said fuel plenum chamber, causing a further fluid fuel to flow into a further fuel plenum chamber, allowing said further fluid fuel to pass from said further fuel plenum chamber via at least one outlet orifice thereof into said airstream, and allowing said further fluid fuel and air from said airstream to pass into said fuel plenum chamber and to leave said fuel plenum chamber via at least one outlet orifice thereof.

In addition, it is preferred that a pressure of said further fuel in said further fluid fuel plenum chamber is greater than a pressure of said airstream, air from said airstream being thereby largely prevented from passing into said fuel plenum chamber.

BRIEF DESCRIPTION OF THE DRAWINGS

Embodiments of the invention will now be described by way of example with reference to the accompanying drawings wherein:

FIG. 1 illustrates the prior art fuel injector arrangement as previously described;

FIG. 2 shows an embodiment of a fuel injector arrangement according to the invention;

FIG. 2*a* shows a modification of the embodiment of FIG. 2, being a section through a fuel post, the line A—A in FIG. 2 being indicative of the positioning rather than the form of the section;

DETAILED DESCRIPTION OF EMBODIMENTS OF THE INVENTION

Figure 3:
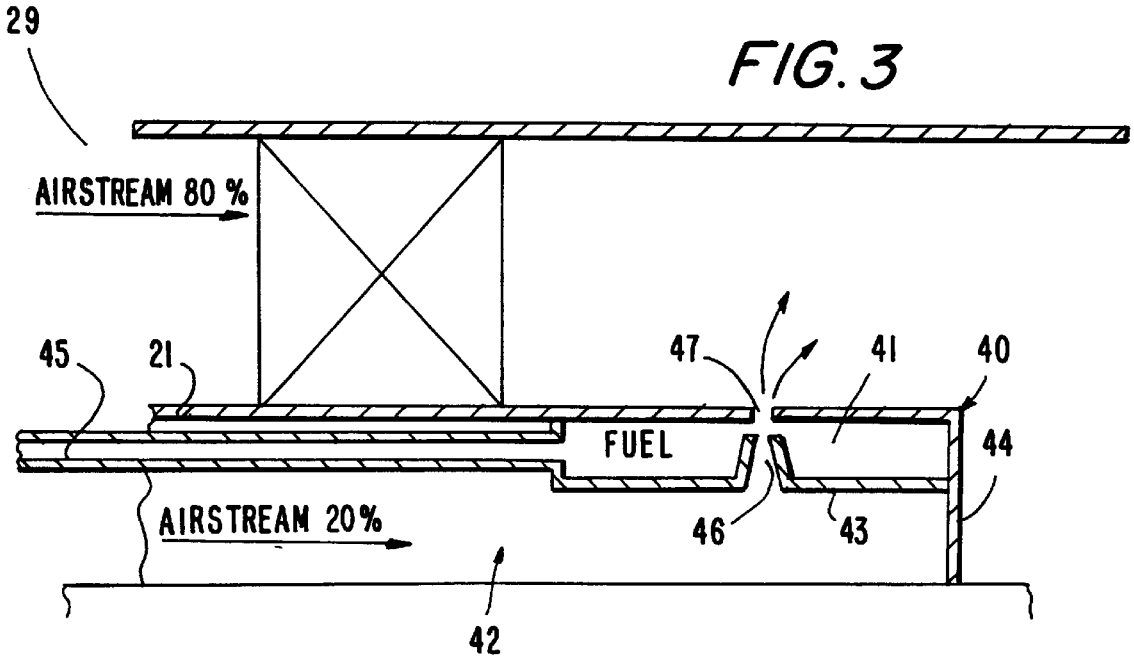
FIG. 3 shows a further embodiment.

The arrangement of FIG. 2 diagrammatically illustrates a primary airstream 29 flowing in a first, annular conduit 10 which conduit incorporates swirl vanes 8 to give swirl to airstream 29 to assist in thorough mixing of fuel forced into the airstream from a housing 26. The air in airstream 29 is supplied by air supply means (not shown) upstream of the swirl vanes 8, but the air supply means also supplies air for a secondary airstream 30 which flows in a second annular-section conduit 31. Annular-section conduit 31 is surrounded by the annular conduit 10, the two conduits being separated by a wall 21, the inner wall of annular conduit 31 being defined by the wall 55 of a circular-section fuel conduit 56 which supplies fuel to a fuel supply means 35. There will obviously be a certain proportion of the total air supplied by the air supply means going to the primary airstream 29 and a certain proportion going into the secondary airstream 30; it will normally be the case that the two proportions will amount in toto to 100% of the air supplied by the air supply means although this will not always necessarily be the case, e.g. where a certain proportion of the air supplied by the air supply means is utilized for cooling. In the embodiment of FIG. 2 it is specifically envisaged that substantially 80% of the air supplied by the air supply means flows to the first conduit 10 to form the primary airstream and the remaining proportion, i.e. substantially 20%, flows to the second conduit 31 to form the secondary airstream.

Extending radially from the wall 21 and radially across conduit 10 is a housing 15, which may take the form of an upstanding cylinder or post with a flat end wall 18 or may be part-annular in form extending around part of the circumference of wall 21, or of annular form.

In any event the housing 15 has two side walls 16, 17 extending substantially at right angles from the wall 21 and interconnected by end wall 18.

Formed transversely of wall 55 and extending between the side walls 16, 17 of the housing 15 is a barrier 19 which acts to define an air chamber 24 and a fuel plenum chamber 25 in the housing 15; the barrier is formed with a plurality of orifices 22 for a purpose as hereinafter described. The barrier 19 passes through the wall 21 into the conduit 31 to form a barrier across conduit 31 which acts to direct air in secondary airstream 30 to the chamber 24 of the housing 15 to one side of the barrier 19, i.e. the left side as shown.

The fuel plenum chamber 25 to the right of barrier 19 receives fluid fuel from the fuel supply means 35. As shown, the fuel supply means 35 is represented as a continuation of conduit 56 to the right of barrier 19 but any arrangement is conceivable which involves supply of air and fuel to respective chambers 24, 25 on opposite sides of barrier 19.

As indicated above, the barrier 19 has a plurality of orifices 22 which are formed as jet orifices whose walls taper towards fuel plenum chamber 25. The side wall 17 constituting the right hand wall of fuel plenum 25 is also provided with orifices 34. Each orifice 34 is in substantially direct alignment with a respective orifice 22 but orifices 22 are of smaller diameter than orifices 34.

The air supplied under pressure from the air supply means to conduit 31 flows therealong to be directed by means of barrier 19 into chamber 24 and thence via orifices 22 into fuel plenum chamber 25 to force fuel therefrom via orifices 34 into the primary airstream 29 flowing around the housing 15.

The fuel will mix with air in the primary airstream to provide a combustible mixture for burning in combustion chamber 14, such mixing being assisted by the rotary motion of the primary airstream given by the swirl vanes 8.

It will be understood that air from the secondary airstream will also exit from the plenum chamber via orifices 34 to become part of the fuel/air mixture downstream of housing 15 and so in the normal arrangement where all the air supplied by the air supply means flows to conduit 10 and conduit 31, the mixture downstream of housing 15 will contain all the air supplied. In this way a controlled lean mixture is obtained (c.f. FIG. 1).

It should be appreciated that there is little or no premixing of the air forced into the chamber 24 with the fuel in the chamber 25; rather the action of the air inside chamber 24 is that of a jet pump impelling fuel through the orifices 34.

As seen in FIG. 2, the orifices 34 are arranged so that fuel is forced into the airstream 29 in directions in line with its axial direction of flow along conduit 10, i.e. parallel to the axis of conduit 10. It is envisaged that the fuel orifices can be otherwise arranged so that fuel is directed into the airstream other than in line with the direction of flow, thereof. FIG. 2*a* shows an arrangement usable for the case where housing 15 is in the form of a cylindrical post wherein the orifices 34*a* are arranged so that fuel is forced into the airstream at right angles to the direction of flow; in practice this will ensure highly efficient mixing of the air and fuel downstream of post 15.

Obviously this positioning of the orifices will necessitate appropriate arrangement of barrier 19 and of the air jet orifices 22 to ensure the necessary alignment.

Other embodiments are possible, e.g. by appropriate arrangement of the fuel and air plenum chambers and the orifices 22, 34, fuel may be ejected at opposite sides of the post transversely into the airstream 29. Also, the barrier 19 and orifices 22 and 34 may be positioned to give an outflow angle of less than 90° to the primary airflow 29.

With a fuel injector constructed and arranged as described, where the fuel is forced 30 or impelled through the orifices by air on the upstream side, the fuel orifices 34 may be constructed to have a larger cross-sectional area than those of conventional injectors, whereby blocking of the orifices may be largely prevented. Furthermore, the fuel/air jets will, in consequence of the larger volumetric flow, penetrate into the primary airstream 29, thus enhancing distribution of the fuel and improving subsequent mixing.

In an alternative embodiment illustrated by FIG. 3, a fuel plenum chamber housing 40 defining a plenum chamber 41 of annular or part-annular formation is formed by part of the wall 21 of a circular section secondary airstream conduit 42 and a wall 43 attached to (e.g. integral with) the wall 21 and the end wall 44 of conduit 42. Fuel is supplied to the fuel plenum chamber 41 via a conduit 45 extending through conduit 42.

Air enters the plenum chamber via at least one orifice 46 in wall 43 and forces fuel out through at least one orifice 47 in wall 21 into primary airstream 29, the orifices 46, 47 being in substantially direct alignment.

Figure 4:
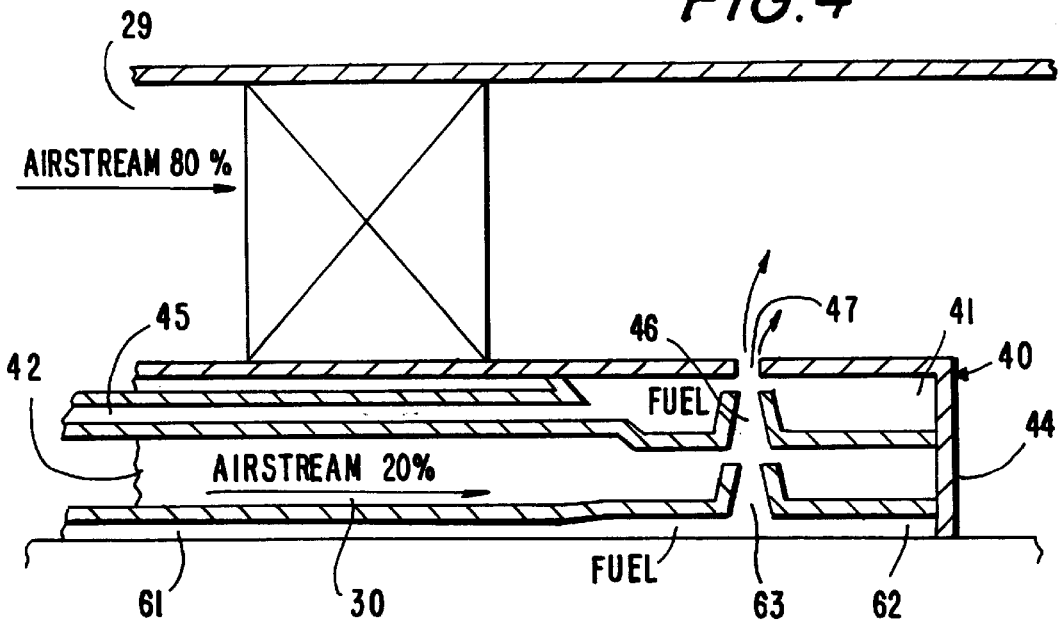
FIG. 4 shows a further embodiment for use with two different fuels with different calorific values.

The embodiment of FIG. 4 involves an arrangement which is effectively a modification of FIG. 3 but which allows changeover from one fuel type to another fuel type (e.g. high calorific type to low calorific type or vice versa) depending on operational requirements e.g. load conditions whilst the engine is running. As shown, the plenum chamber 41 receives fuel, having a high calorific value, through conduit 45. Fuel of (relatively) low calorific value is supplied by a conduit 61 to a further fuel plenum chamber 62; the conduit 61 is shown as a circular conduit extending axially through the secondary airstream conduit 42. The plenum chamber 62 has orifice(s) 63 in substantially direct alignment with orifice(s) 46 and hence with orifice(s) 47. When the arrangement is operating under conditions requiring combustion of high calorific value fuel the air in secondary airstream 30 forces fuel from plenum chamber 41 through orifices 47 into the primary airstream 29 as in the embodiment of FIG. 3. However, when the operating conditions require combustion of the low calorific value fuel, the flow of the high calorific value fuel in conduit 45 is initially cut off and thereafter the low calorific fuel is caused to flow through conduit 61 into fuel plenum 62. The fuel exits plenum chamber 62 via orifices 63 into the secondary airstream and thence into fuel plenum chamber 41 and via orifices 47 into the primary airstream. It should be appreciated that as flow of low calorific value fuel increases (as required by operational needs) its flow may act to cut off the flow of the secondary airstream (which is of intermediate pressure between the pressures in the fuel plenum chambers) so that at maximum fuel requirement there would be no secondary air flow through orifices 46. On changeover from low calorific value fuel to high calorific value fuel the flow of air through orifices 46 recommences.

Obviously, an appropriate control means responsive to operating conditions (e.g. load and/or speed conditions of the turbine, engine or burner) is provided to control the changeover from one fuel to the other.

Many other embodiments of the invention are possible, utilizing various arrangements of air conduit(s), fuel conduit (s) and plenum chamber(s), within the scope of the appended claims.

Normally the peripheries of the orifices provided will be made smooth so that burrs do not affect the flow rate.

Further, the form and arrangement of the orifices for air and fuels in the plenum housing will be selected as is appropriate for the particular environment and the particular fuel used. Inter alia the diameter and form of the individual orifices and the distances between adjacent air and fuel orifices will be selected in the light of these factors. Furthermore the housing can be constructed and mounted in such a way that a degree of adjustability of the orifice size and/or spacing is possible to allow for changes in fuel type, operating pressure etc, e.g. by utilizing replaceable nozzles.

It should be appreciated that, although the various embodiments of the invention described above have assumed the use of blades or vanes in the annular conduit 10 to impart swirl to the airstream 29 and thereby enhance mixing, the fuel injector according to the invention may dispense with this feature.

What is claimed is:

1. A fuel injector arrangement for conveying combustion air under pressure and a fluid fuel to a combustion apparatus, comprising:

a) a primary conduit for conveying a major proportion of the combustion air along a primary flow path to the combustion apparatus, the major proportion constituting a primary airstream;

b) a secondary conduit in the primary conduit, for conveying a minor proportion of the combustion air along a secondary flow path to the combustion apparatus, the minor proportion constituting a secondary airstream;

c) a first apertured wall having a fuel orifice;

d) a second apertured wall bounding a fuel plenum chamber with the first apertured wall, and having a jet orifice for conveying the secondary airstream into the fuel plenum chamber, the jet orifice being spaced from, and aligned with, the fuel orifice, the jet orifice having tapered walls that converge toward, but terminate short of, the fuel orifice, as considered downstream along the secondary flow path; and e) a fuel conduit for conveying the fluid fuel along a fuel path to the fuel plenum chamber in which the fluid fuel is entrained by the secondary airstream passing through the jet orifice and is ejected through the fuel orifice into the primary flow path to the combustion apparatus.

2. The arrangement as claimed in claim 1, wherein the major proportion is on the order of 80% of the combustion air, and wherein the minor proportion is on the order of 20% of the combustion air.

3. The arrangement as claimed in claim 1, wherein the primary conduit is annular and surrounds the secondary conduit.

4. The arrangement as claimed in claim 1, wherein the secondary conduit is annular and surrounds the fuel conduit.

5. The arrangement as claimed in claim 1, wherein the jet orifice has a minimum cross-section, and wherein the fuel orifice has a cross-section larger than said cross-section of the jet orifice.

6. The arrangement as claimed in claim 1; and further comprising a swirler in the primary conduit, for swirling the primary airstream.

7. The arrangement as claimed in claim 1, wherein the first apertured wall has additional fuel orifices, and wherein the second apertured wall has additional jet orifices, each of the additional jet orifices being spaced from, and aligned with, respective additional fuel orifices.

8. The arrangement as claimed in claim 7, wherein the apertured walls extend transversely across the primary flow path, and wherein each of the fuel orifices faces downstream along the primary flow path.

9. The arrangement as claimed in claim 8; and further comprising a housing extending transversely across the primary flow path; and wherein the first apertured wall is located at a downstream side of the housing; and wherein the second apertured wall is located within the housing and subdivides an interior of the housing into an air chamber at an upstream side of the second apertured wall, and the fuel plenum chamber at a downstream side of the second apertured wall.

10. The arrangement as claimed in claim 1, wherein the apertured walls extend in a direction generally parallel to the primary flow path, and wherein the fuel orifice faces in a direction transversely of the primary flow path.

11. The arrangement as claimed in claim 10; and further comprising a third apertured wall extending in the direction generally parallel to the primary flow path, the third apertured wall having a tapered orifice spaced from, and aligned with, the jet orifice.

12. The arrangement as claimed in claim 11, wherein fluid fuel having a first calorific value is ejected from the fuel orifice, and wherein fluid fuel having a second calorific value is conveyed through the tapered orifice for conveyance through the jet orifice and the fuel orifice, all of said orifices being spaced apart along a direction transversely of the primary flow path.

13. A method of operating a fuel injector arrangement for conveying combustion air under pressure and a fluid fuel to a combustion apparatus, comprising the steps of:

a) conveying a major proportion of the combustion air along a primary flow path to the combustion apparatus, the major proportion constituting a primary airstream;

b) conveying a minor proportion of the combustion air along a secondary flow path to the combustion apparatus, the minor proportion constituting a secondary airstream;

c) forming a fuel plenum chamber between first and second apertured walls, the first apertured wall having a fuel orifice, and the second apertured wall having a jet orifice spaced from, and aligned with, the fuel orifice, the jet orifice having tapered walls that converge toward, but terminate short of, the fuel orifice, as considered downstream along the secondary flow path; and d) conveying the fluid fuel along a fuel path to the fuel plenum chamber in which the fluid fuel is entrained by the secondary airstream passing through the jet orifice and is ejected through the fuel orifice into the primary flow path to the combustion apparatus.

14. The method as claimed in claim 13, wherein the major proportion is on the order of 80% of the combustion air, and wherein the minor proportion is on the order of 20% of the combustion air.

15. The method as claimed in claim 13; and further comprising the step of conveying a different fluid fuel through a tapered orifice for conveyance through the jet orifice and the fuel orifice, all of said orifices being spaced apart along a direction transversely of the primary flow path.

16. The method as claimed in claim 15, wherein the fluid fuels have different calorific values.

17. The method as claimed in claim 15, wherein the fluid fuel conveying steps are performed sequentially.

* * * * *